US005890416A

United States Patent [19]

Thieme et al.

[11] Patent Number: 5,890,416

[45] Date of Patent: Apr. 6, 1999

[54] LIQUID-COOLED PISTON

[75] Inventors: Stephan Thieme, Hersbruck; Edgar Martin, Nurnberg, both of Germany

[73] Assignee: Alcan Deutschland GmbH, Gottingen, Germany

[21] Appl. No.: 14,083

[22] Filed: Jan. 27, 1998

[30] Foreign Application Priority Data

Jan. 28, 1997 [GB] United Kingdom ..... 197 03 001.7

[51] Int. Cl.[6] ..... F01B 31/08; F01P 1/04

[52] U.S. Cl. ..... 92/186; 123/41.35

[58] Field of Search ..... 92/186; 123/41.35

[56] References Cited

U.S. PATENT DOCUMENTS

| | | | |
|---|---|---|---|
| 1,547,687 | 7/1925 | Rohwer | 92/186 X |
| 4,530,312 | 7/1985 | Kanda et al. . | |
| 4,581,983 | 4/1986 | Moebus | 92/186 |
| 4,587,932 | 5/1986 | Moebus | 92/186 X |
| 5,730,090 | 3/1998 | Kling et al. | 92/186 X |

FOREIGN PATENT DOCUMENTS

| | | | |
|---|---|---|---|
| 1207152 | 12/1965 | Germany | 123/41.35 |
| 1905609 | 8/1970 | Germany | 123/41.35 |
| 3019953 | 12/1980 | Germany . | |
| 150542 | 8/1985 | Germany | 123/41.35 |
| 3444661 | 6/1986 | Germany . | |
| 3518746 | 1/1987 | Germany . | |
| 3819663 | 6/1989 | Germany . | |
| 43944 | 3/1984 | Japan | 123/41.35 |
| 973900 | 11/1982 | Russian Federation | 123/41.35 |
| 2055448 | 3/1981 | United Kingdom . | |
| 2312942 | 11/1997 | United Kingdom . | |

*Primary Examiner*—John E. Ryznic

*Attorney, Agent, or Firm*—Stevens, Davis, Miller & Mosher, L.L.P.

[57] ABSTRACT

A liquid-cooled internal combustion engine piston (10) comprises on the one hand at least one annular segment-shaped coolant duct (12*a*, 12*b*) formed within an upper piston member and having openings (16*a*, 16*b*, 18) at sites symmetrical relative to the gudgeon pin axis (14) for supplying and discharging oil. On the other hand, an approximately radial communicating duct (20) enclosed in its course toward the crank chamber and connected to the annular segmented ducts (12*a*, 12*b*) in the region of the openings (16*a*, 16*b*, 18) is provided.

32 Claims, 3 Drawing Sheets

LIQUID-COOLED PISTON

TECHNICAL FIELD

The invention relates to a liquid-cooled piston for internal combustion engines.

Due to the combustion processes taking place within the combustion chamber, the pistons of internal combustion engines are subject to high thermal loads. In the case of diesel engines and supercharged engines, it is particularly expedient to ensure that the pistons are cooled by supplying coolant to cavities within the piston.

PRIOR ART

It is known from DE 30 19 953 A1 that an annular coolant duct should be provided in an upper piston m ember; coolant, for example oil, is applied to this duct through suitable inlet bores from the crank chamber side. The coolant is drained roughly in the center of the piston toward the crank chamber via a short radial coolant duct which is branched off from the annular coolant duct. Such a configuration of coolant ducts suffers from drawbacks because the coolant in the central region of the piston, which is subject to a particularly high thermal load, loses concocts with the piston when the coolant flows out of the discharge opening. It is consequently not always possible to ensure that the piston is sufficiently cooled by the arrangement of coolant ducts known from the above document. Since the oil discharge or outlet has to be located above the pin bearing in this known piston, the depicted coolant ducts are also only to be used for flat recesses (or depressions or troughs) or only on half a side.

A liquid-cooled piston is known from DE 34 44 661 A1; in addition to an annular coolant duct, this piston comprises a plurality of blind-end bores which branch away from the annular coolant duct toward the piston head. A plurality of star-shaped radial coolant ducts is also formed, and a discharge opening is provided at the intersection of these coolant ducts. This known piston therefore also suffers from the drawback that the coolant flows down in that region which is subject to maximum thermal load, with the result that cooling is insufficient. The described arrangement of coolant ducts also has an extremely complicated shape, making it possible to manufacture this piston only with an undesirably high outlay and extremely complicated multi-arm casting cores. This disadvantage also particularly affects an embodiment of the piston known from DE 34 44 661 A1 in which no discharge opening is formed at the intersection of the radial coolant ducts.

Finally, a liquid-cooled piston comprising two annular cavities in the upper piston member and in the lower piston member as well as a central cavity is known from DE 38 19 663. Due to the complicated design of the existing coolant ducts, however, this piston can also only be manufactured with a high production outlay.

In view of these disadvantages of the liquid-cooled pistons known in the prior art, the present invention is based upon the object of producing a liquid-cooled internal combustion engine piston in which sufficient cooling of the piston is guaranteed in all areas and which can also be produced with negligible production outlay and can be installed with minimum assembly outlay.

DESCRIPTION OF THE INVENTION

This object is solved by a piston comprising the features of claim 1.

On the one hand, two annular segment-shaped coolant ducts formed in an upper piston member are therefore provided in the piston according to the invention; these ducts each have openings, toward a crank chamber, at a site which is symmetrical relative to a gudgeon pin axis for the purpose of supplying and discharging coolant. On the other hand, a radial communicating duct which is enclosed in terms of its course toward the crank chamber and which with the annular segment-shaped ducts in the region of the openings merges into the crank chamber.

The simple design of the cavities provided in the piston according to the invention for the purpose of supplying coolant, viz. two annular segment-shaped coolant ducts and one communicating or bridging duct, means that the piston according to the invention can be produced with negligible outlay by means of a simple casting core. The symmetry of the piston according to the invention relative to the gudgeon pin axis also enjoys the advantage that it is unnecessary to pay attention to the piston's alignment when it is fitted. As already mentioned, openings are provided within the annular segment-shaped coolant ducts at sites disposed symmetrically in relation to the gudgeon pin axis, and the regions of the openings are connected together by the radial communicating duct. The piston is therefore designed to be symmetrical to the gudgeon pin axis and each of the openings formed in the annular segment-shaped coolant ducts can be used as a supply or discharge opening. When mounting the piston, it consequently does not matter which of the two openings is disposed in the area of that device within the crank chamber which ensures that coolant, e.g. cooling oil, is supplied to the piston cavities.

The communicating duct which runs beneath the combustion chamber recess in the piston head is also enclosed toward the crank chamber. In the case of the piston according to the invention, the coolant is therefore on no account drained off within a central piston region that is subject to particularly high thermal loads. Because the coolant flows through the communicating duct below the combustion chamber recess, the heat transferred to the piston is expediently dissipated, and the coolant is discharged within a marginal region which is in any case subject to a lower degree of thermal load. This expediently allows heat to be dissipated to a constantly sufficient extent.

Preferred embodiments of the invention are described in the other claims.

The communicating duct is preferably designed at an angle, at least zonally. By designing the communicating duct in such a way, it is on the whole possible to adapt advantageously the course of the communicating duct to the shape of the combustion chamber recess or piston head.

This also ensures a reliable flow of coolant, without the risk of accumulation or pressure buildup.

In terms of its course, the communicating duct can advantageously be adapted to the base of a combustion chamber recess formed in the piston head. This measure allows the piston to be particularly reliably cooled in that region of the combustion chamber recess which is heated to a particularly considerable extent.

In special tests, it has also been advantageously shown that the communicating duct should be chiefly formed above the level of the annular segment-shaped coolant ducts. This enables the communicating duct to be brought up particularly close to the piston head so as to cause this region to be cooled, thereby simultaneously ensuring in a simple manner the supply of coolant to the openings located below the communicating duct in the region of the annular segment-shaped coolant ducts.

As regards distributing the coolant into the opening which acts as an inlet opening for the annular segment-shaped coolant ducts, there are particular benefits if deflectors are respectively provided in the area of the coolant duct openings; depending on the piston's stroke length within the cylinder, these deflectors deflect a jet of coolant directed at the opening into one of the annular segment-shaped coolant ducts or into the communicating duct. The described deflector relates for example to a rib-like projection which is formed in the area of the opening base i.e. that zone which is closest to the piston head. By suitably designing these deflectors, it is thereby ensured during the course of the operating cycle that coolant is supplied to all the coolant ducts of the piston according to the invention.

With regard to the cross sections of the coolant ducts, tests have shown that it is advantageous for them to be designed such as to increase at a distance from the openings. In conjunction with suitably designed, comparatively large openings through which the coolant drains, this approach enables a short dwell time of the cooling oil, which ensures that the piston head and combustion chamber recess base are heated to an extremely negligible extent.

BRIEF DESCRIPTION OF THE DRAWINGS

An exemplary embodiment of the invention will now be explained in further detail with reference to the attached drawings.

DESCRIPTION OF AN EXEMPLARY EMBODIMENT OF THE INVENTION

Figure 1:
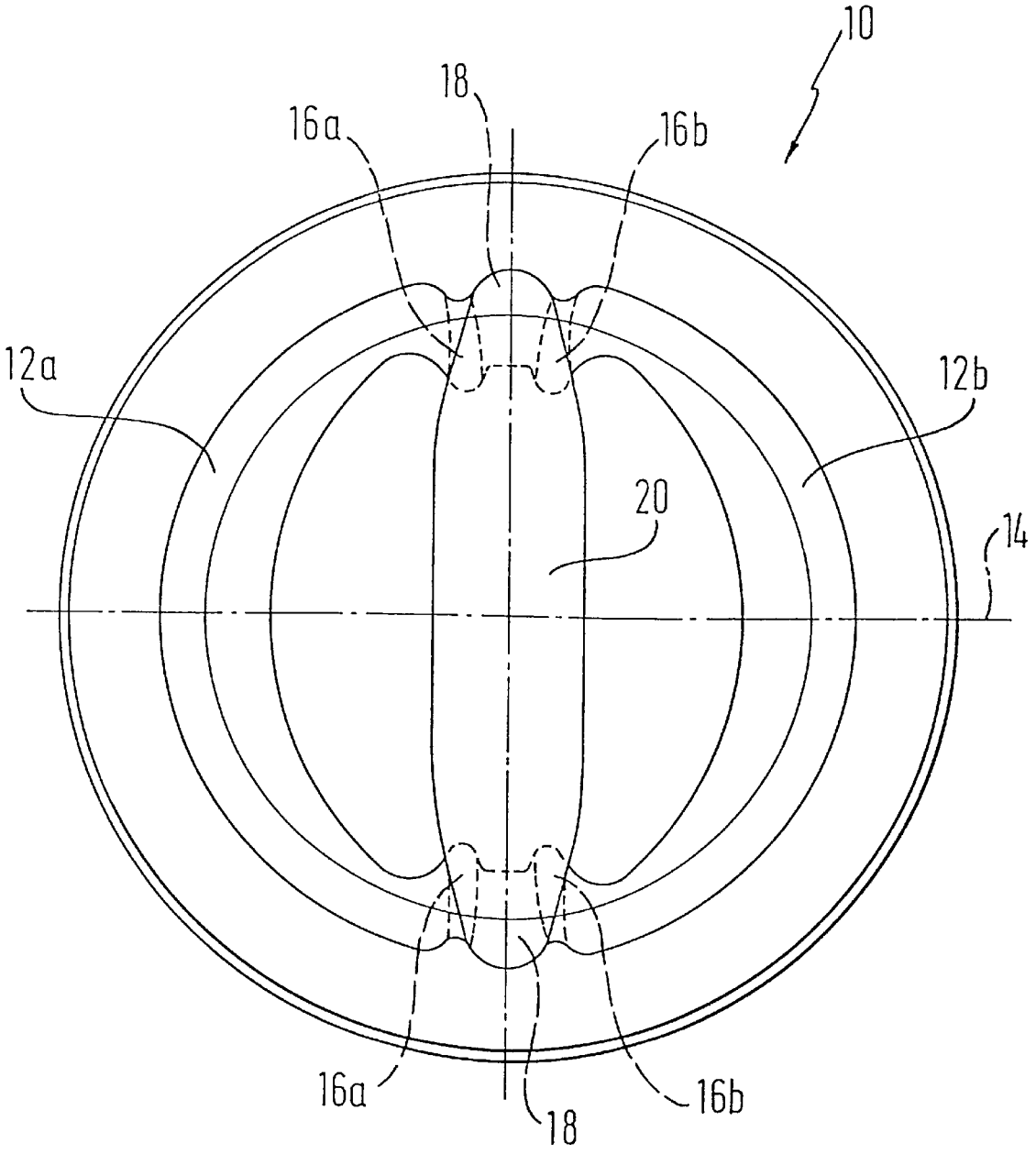
FIG. 1 shows a schematic horizontal projection of a piston according to the invention with the course of the coolant ducts.

FIG. 1 shows the course of the coolant ducts as a schematic horizontal projection of the piston 10 according to the invention. In detail, annular segment-shaped coolant ducts 12*a* and 12*b* are each formed in the radially outer half of the upper piston member of the piston 10. In the course of the annular segment-shaped coolant ducts 12*a* and 12*b*, openings 16*a*, 16*b* and 18 are formed on two diametrically opposed sites symmetrical to the gudgeon pin axis 14. The mouths or outlets of the openings 16*a*, 16*b* and 18 are marked by a broken line in FIG. 1.

A communicating duct 20, also known as a bridging duct, is connected to the annular segment-shaped coolant ducts 12*a*, 12*b* in the region of the openings 16*a* and 16*b*. According to the invention, this communicating duct 20 is not opened, in terms of its course, toward the crank chamber. On the contrary, the communicating duct 20 communicates with the annular segment-shaped ducts 12*a* and 12*b* only in the area of the openings 16*a*, 16*b* and 18. This allows coolant to be supplied via one of the two openings 16*a* and 16*b* respectively into the annular segment-shaped coolant ducts 12*a*, 12*b* or via the opening 18 into the communicating duct 20.

As a result of heat transfer from the upper piston member's surrounding areas located below the piston head and particularly located within the area of the combustion chamber recess, the coolant reaching the communicating duct 20 cools these piston zones. The coolant drains through the respectively other opening 18. As described above, the piston is completely symmetrical to the gudgeon pin axis 14 as a result of correspondingly arranging the openings 16*a*, 16*b* and the communicating duct 20, making it possible to simplify piston installation in that attention does not have to be paid to the alignment of the piston 10.

Depending on which of the openings 16*a*, 16*b*, 18 is disposed above that device within the crank chamber which ensures that the jet of coolant is supplied to the piston 10, the coolant passes through the corresponding opening into one of the coolant ducts 12*a*, 12*b* and 20 and leaves these ducts through the other one of the openings 16*a*, 16*b*, 18. It can also be identified in the horizontal projection of FIG. 1 that the ducts 12*a*, 12*b* and 20 are designed to increase in that area at a distance from the openings 16*a*, 16*b*, 18, which has proved to be advantageous as concerns the cooling action caused by the coolant which flows through.

Figure 2:
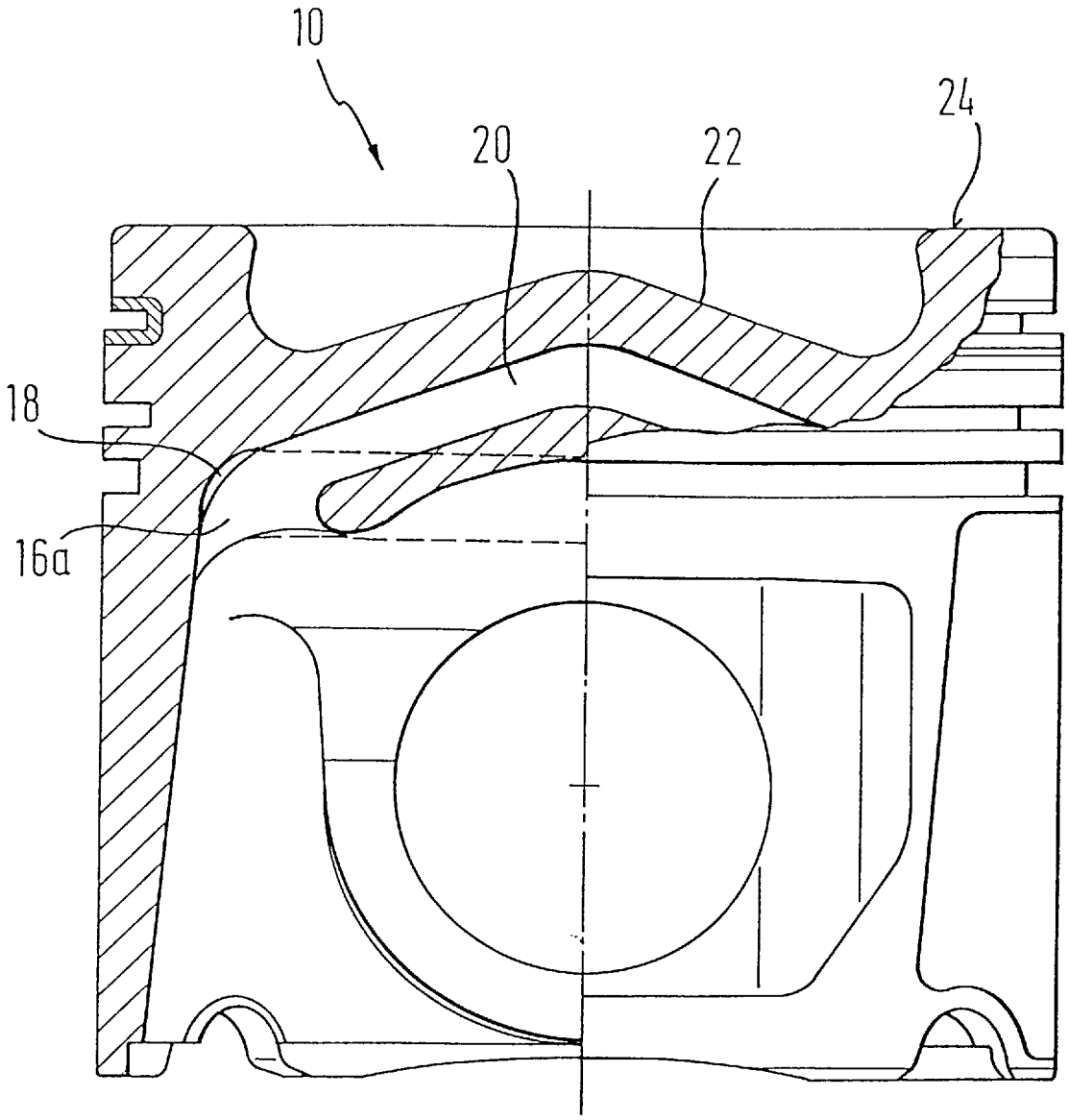
FIG. 2 shows a sectional view of the piston perpendicular to the gudgeon pin axis.

In the sectional representation of FIG. 2, which depicts a section perpendicular to the gudgeon pin axis, the course of the communicating duct 20 adapted to a combustion chamber recess 22 is particularly discernible. The communicating duct 20, which is connected to the annular segment-shaped duct 12*a* (not shown in FIG. 2) in the area of the openings 16*a*, 16*b*, 18—of which only the openings 16*a* and 18 are shown—runs upward starting from the area of the opening 18, is at an angle toward the piston head 24 and is adapted as a result to the shape of the combustion chamber recess 22.

As can be identified in FIG. 2, the piston head 24 is comparatively slightly recessed in a central portion, while the recess increases toward the marginal regions in order to form an annular combustion chamber recess. For optimum cooling of the region beneath the combustion chamber recess 22—a region which is subject to a high degree of thermal load—the communicating duct 20 is designed to rise from the marginal region toward the central region of the piston. Due to the symmetrical shape of the combustion chamber recess 22, the communicating duct 20 also runs symmetrical to the gudgeon pin axis, producing a largely roof-like course of the communicating duct 20.

As a result, good heat dissipation can be ensured by the comparatively small distance of the communicating duct 20 from the combustion chamber recess 22. In particular, it is possible to speak of a course of the communicating duct 20 which is adapted to the shape of the combustion chamber recess 22 and which advantageously ensures optimized cooling for these zones.

It is also apparent from FIG. 2, in which the complete course of the communicating duct 20 is indicated, that according to the invention, this duct is sealed toward the crank chamber so that the coolant flows off in a marginal area via one of the openings 18, thus particularly ensuring that the central region which is subject to a particular thermal load is adequately cooled.

Figure 3:
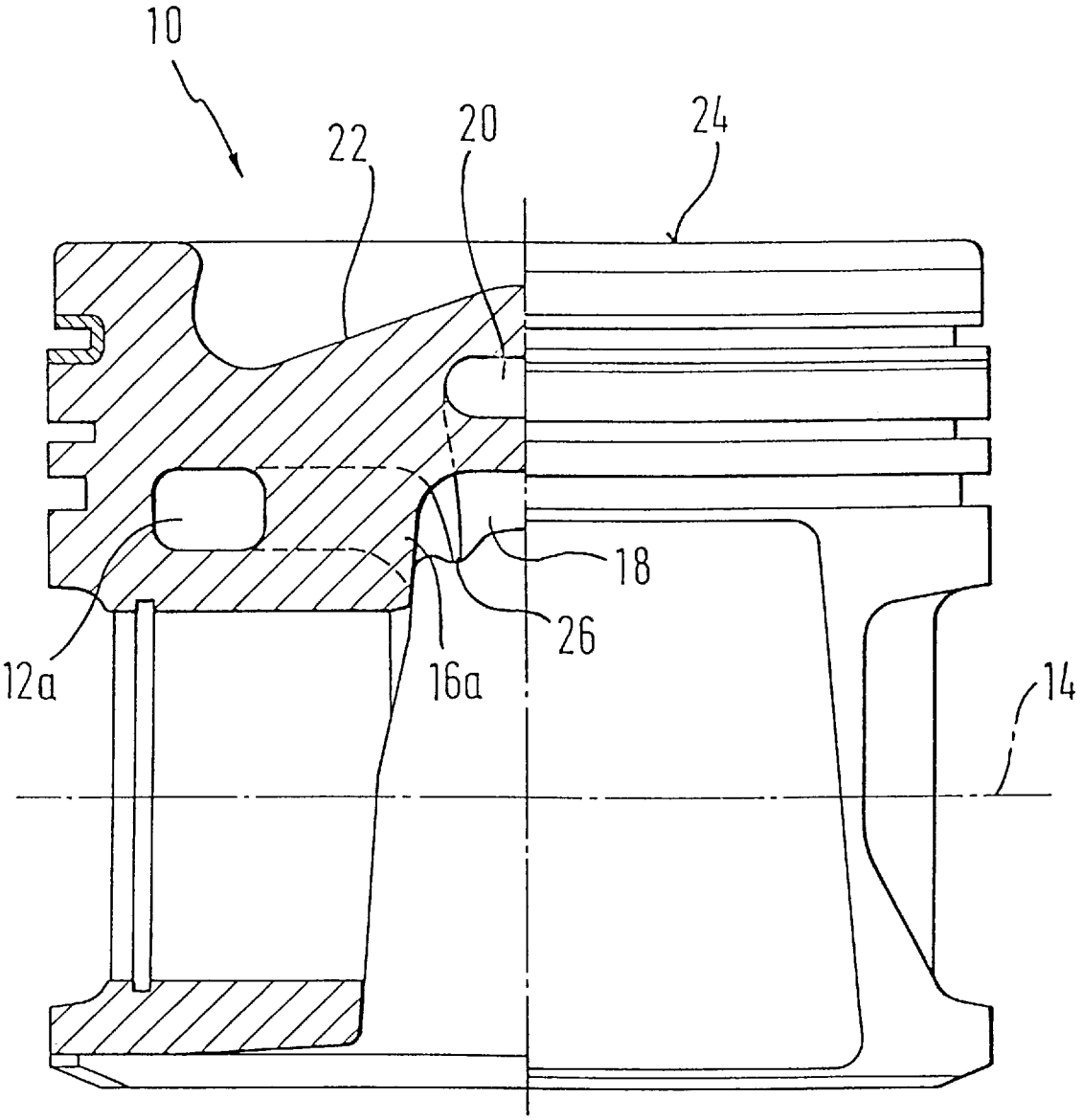
FIG. 3 a side view of the piston according to the invention with a partial section parallel to the gudgeon pin axis.

An optional feature of the indicated embodiment of the piston 10 according to the invention, viz. one of the deflectors 26, can be identified in the partial section of FIG. 3 parallel to the gudgeon pin axis 14. The sectional representation of FIG. 3 shows on the one hand the arrangement of the annular segment-shaped coolant ducts 12*a*, 12*b* in a marginal region and in a lower region of the upper piston member. In relation to the central piston axis perpendicular to the gudgeon pin axis, the coolant duct 12*b* (not depicted in FIG. 3) is symmetrical to the depicted coolant duct 12*a*. It can also be seen in the central upper region of the piston 10 that the communicating duct 20 is brought up to the combustion chamber recess 22 for the purpose of cooling these zones of the piston 10.

In the embodiment depicted, deflectors 26 partially marked in FIG. 3 by a broken line, in the form of a rounded projection or a rib, are located in the area of the openings 16*a* and 18 (equally symmetrical in the area of the non-depicted opening 16*b*) to the coolant ducts 12*a* and 20 (equally symmetrical to the non-depicted coolant duct 12*b*). Due to the stroke length of the piston 10 in the cylinder liner, these deflectors 26, which are impacted by the coolant jet (not shown), ensure that the coolant jet is deflected in accordance with the depiction of FIG. 3 into the left or right annular segment-shaped coolant duct 12*a*, 12*b* or into the communicating duct 20 (as already mentioned, the right annular segment-shaped coolant duct 12*b* is not depicted). The deflectors 26 are each formed on the base of the opening 16*a*, 16*b*, 18, i.e. on that side of the opening 16*a*, 16*b*, 18 opposite the coolant inlet, and in horizontal projection, they have the shape marked by the broken line in FIG. 1. In that opening 16*a*, 16*b*, 18 which ensures oil discharge, the corresponding deflector 26 does not stop the cooling oil from flowing out, thus enabling the piston 10 according to the invention to be designed symmetrically and allowing it to be installed in any orientation so as to utilize the advantageous effect of the deflectors 26 for the opening 16*a*, 16*b*, 18 used as an inlet opening.

We claim:

1. A liquid-cooled internal combustion engine piston (10) comprising at least one annular segment-shaped coolant duct (12*a*, 12*b* ) formed in an upper piston member and having openings (16*a*, 16*b*) for supplying and discharging coolant toward a crank chamber at sites symmetrical relative to a gudgeon pin axis (14), and an approximately radial communicating duct (20) including an opening (18) and enclosed in its course toward the crank chamber and connected to said annular segment-shaped ducts (12*a*, 12*b*) in the area of said openings (16*a*, 16*b*, 18).

2. A liquid-cooled internal combustion engine piston according to claim 1, wherein said communicating duct (20) is formed at an upward angle of at least in the area of said openings (16*a*, 16*b*, 18).

3. A liquid-cooled internal combustion engine piston according to claim 1, wherein with regard to its course, said communicating duct (20) is adapted to the base of a combustion chamber recess (22) formed in a piston head (24).

4. A liquid-cooled internal combustion engine piston according to claim 2, wherein with regard to its course, said communicating duct (20) is adapted to the base of a combustion chamber recess (22) formed in a piston head (24).

5. A liquid-cooled internal combustion engine piston according to claim 1, wherein said communicating duct (20) mainly runs above the level of said annular segment-shaped coolant ducts (12*a*, 12*b*).

6. A liquid-cooled internal combustion engine piston according to claim 2, wherein said communicating duct (20) mainly runs above the level of said annular segment-shaped coolant ducts (12*a*, 12*b*).

7. A liquid-cooled internal combustion engine piston according to claim 3, wherein said communicating duct (20) mainly runs above the level of said annular segment-shaped coolant ducts (12*a*, 12*b*).

8. A liquid-cooled internal combustion engine piston according to claim 4, wherein said communicating duct (20) mainly runs above the level of said annular segment-shaped coolant ducts (12*a*, 12*b*).

9. A liquid-cooled internal combustion engine piston (10) comprising at least one annular segment-shaped coolant duct (12*a*, 12*b*) formed in an upper piston member and having openings (16*a*, 16*b*) for supplying and discharging coolant toward a crank chamber at sites symmetrical relative to a gudgeon pin axis (14), and an approximately radial communicating duct (20) including an opening (18) and enclosed in its course toward the crank chamber and connected to said annular segment-shaped ducts (12*a*, 12*b*) in the area of said openings (16*a*, 16*b*, 18), whereby a deflector (26) is respectively provided in the area of said openings (16*a*, 16*b*, 18) of said coolant ducts (12*a*, 12*b*, 20), said deflector deflecting in accordance with a stroke length of said piston (10) within a cylinder a coolant jet directed at said openings (16*a*, 16*b*, 18) into one of said two annular segment-shaped coolant ducts (12*a*, 12*b*) or into said communicating duct (20).

10. A liquid-cooled internal combustion engine piston according to claim 9, wherein said communicating duct (20) is formed at an upward angle of at least in the area of said openings (16*a*, 16*b*, 18).

11. A liquid-cooled internal combustion engine piston according to claim 9, wherein with regard to its course, said communicating duct (20) is adapted to the base of a combustion chamber recess (22) formed in a piston head (24).

12. A liquid-cooled internal combustion engine piston according to claim 10, wherein with regard to its course, said communicating duct (20) is adapted to the base of a combustion chamber recess (22) formed in a piston head (24).

13. A liquid-cooled internal combustion engine piston according to claim 9, wherein said communicating duct (20) mainly runs above the level of said annular segment-shaped coolant ducts (12*a*, 12*b*).

14. A liquid-cooled internal combustion engine piston according to claim 10, wherein said communicating duct (20) mainly runs above the level of said annular segment-shaped coolant ducts (12*a*, 12*b*).

15. A liquid-cooled internal combustion engine piston according to claim 11, wherein said communicating duct (20) mainly runs above the level of said annular segment-shaped coolant ducts (12*a*, 12*b*).

16. A liquid-cooled internal combustion engine piston according to claim 12, wherein said communicating duct (20) mainly runs above the level of said annular segment-shaped coolant ducts (12*a*, 12*b*).

17. A liquid-cooled internal combustion engine piston according to claim 1, wherein the cross sections of said coolant ducts (12*a*, 12*b*, 20) are designed such as to increase at a distance from said openings (16*a*, 16*b*, 18).

18. A liquid-cooled internal combustion engine piston according to claim 2, wherein the cross sections of said coolant ducts (12*a*, 12*b*, 20) are designed such as to increase at a distance from said openings (16*a*, 16*b*, 18).

19. A liquid-cooled internal combustion engine piston according to claim 3, wherein the cross sections of said coolant ducts (12*a*, 12*b*, 20) are designed such as to increase at a distance from said openings (16*a*, 16*b*, 18).

20. A liquid-cooled internal combustion engine piston according to claim 4, wherein the cross sections of said coolant ducts (12*a*, 12*b*, 20) are designed such as to increase at a distance from said openings (16*a*, 16*b*, 18).

21. A liquid-cooled internal combustion engine piston according to claim 5, wherein the cross sections of said coolant ducts (12*a*, 12*b*, 20) are designed such as to increase at a distance from said openings (16*a*, 16*b*, 18).

22. A liquid-cooled internal combustion engine piston according to claim 6, wherein the cross sections of said coolant ducts (12*a*, 12*b*, 20) are designed such as to increase at a distance from said openings (16*a*, 16*b*, 18).

23. A liquid-cooled internal combustion engine piston according to claim 7, wherein the cross sections of said coolant ducts (12*a*, 12*b*, 20) are designed such as to increase at a distance from said openings (16*a*, 16*b*, 18).

24. A liquid-cooled internal combustion engine piston according to claim 8, wherein the cross sections of said coolant ducts (12*a*, 12*b*, 20) are designed such as to increase at a distance from said openings (16*a*, 16*b*, 18).

25. A liquid-cooled internal combustion engine piston according to claim 9, wherein the cross sections of said coolant ducts (12*a*, 12*b*, 20) are designed such as to increase at a distance from said openings (16*a*, 16*b*, 18).

26. A liquid-cooled internal combustion engine piston according to claim 10, wherein the cross sections of said coolant ducts (12*a*, 12*b*, 20) are designed such as to increase at a distance from said openings (16*a*, 16*b*, 18).

27. A liquid-cooled internal combustion engine piston according to claim 11, wherein the cross sections of said coolant ducts (12*a*, 12*b*, 20) are designed such as to increase at a distance from said openings (16*a*, 16*b*, 18).

28. A liquid-cooled internal combustion engine piston according to claim 12, wherein the cross sections of said coolant ducts (12*a*, 12*b*, 20) are designed such as to increase at a distance from said openings (16*a*, 16*b*, 18).

29. A liquid-cooled internal combustion engine piston according to claim 13, wherein the cross sections of said coolant ducts (12*a*, 12*b*, 20) are designed such as to increase at a distance from said openings (16*a*, 16*b*, 18).

30. A liquid-cooled internal combustion engine piston according to claim 14, wherein the cross sections of said coolant ducts (12*a*, 12*b*, 20) are designed such as to increase at a distance from said openings (16*a*, 16*b*, 18).

31. A liquid-cooled internal combustion engine piston according to claim 15, wherein the cross sections of said coolant ducts (12*a*, 12*b*, 20) are designed such as to increase at a distance from said openings (16*a*, 16*b*, 18).

32. A liquid-cooled internal combustion engine piston according to claim 16, wherein the cross sections of said coolant ducts (12*a*, 12*b*, 20) are designed such as to increase at a distance from said openings (16*a*, 16*b*, 18).

* * * * *

UNITED STATES PATENT AND TRADEMARK OFFICE

CERTIFICATE OF CORRECTION

PATENT NO. : 5,890,416

DATED : April 6, 1999

INVENTOR(S) : THIEME et al

It is certified that error appears in the above-identified patent and that said Letters Patent is hereby corrected as shown below:

On the title page, item

[30], change "[GB] United Kingdom .....197 03 001.7" to --[DE] Germany ..... 197 03 001.7--

Signed and Sealed this

Eighteenth Day of January, 2000

*Attest:*

Q. TODD DICKINSON

*Attesting Officer*

*Commissioner of Patents and Trademarks*